US007750853B2

(12) United States Patent
Cirineo et al.

(10) Patent No.: US 7,750,853 B2
(45) Date of Patent: Jul. 6, 2010

(54) PARTIALLY SHORTED MICROSTRIP ANTENNA

(75) Inventors: Anthony Cirineo, Ventura, CA (US); Albert F. Davis, Ventura, CA (US); Marvin L. Ryken, Oxnard, CA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 148 days.

(21) Appl. No.: 12/181,421

(22) Filed: Jul. 29, 2008

(65) Prior Publication Data

US 2010/0026579 A1 Feb. 4, 2010

(51) Int. Cl.
*H01Q 1/38* (2006.01)
*H01Q 1/42* (2006.01)

(52) U.S. Cl. ..... 343/700 MS; 343/872

(58) Field of Classification Search ..... 343/700 MS, 343/757, 872, 893

See application file for complete search history.

(56) References Cited

U.S. PATENT DOCUMENTS 4,980,692 A * 12/1990 Rudish et al. ..... 343/700 MS
5,955,997 A * 9/1999 Ho et al. ..... 343/767
2002/0113743 A1* 8/2002 Judd et al. ..... 343/757

* cited by examiner

*Primary Examiner*—Shih-Chao Chen
(74) *Attorney, Agent, or Firm*—Christopher Blackburn; David Kalmbaugh

(57) ABSTRACT

A partially shorted microstrip antenna configured to wrap around a projectile's body without interfering with the aerodynamic design of the projectile. The microstrip antenna has three identical conformal antenna elements equally spaced around the circumference of the projectile's body. The antenna has an operating frequency of 231.0 MHz±400 KHz. Each antenna element includes a plurality of vias which operate as a partial short connecting the radiating element to the ground plane and thereby increase the bandwidth of the antenna element.

15 Claims, 8 Drawing Sheets

PARTIALLY SHORTED MICROSTRIP ANTENNA

BACKGROUND OF THE INVENTION

1. Field of the Invention

The present invention relates generally to a microstrip antenna designed for use on a weapons system. More specifically, the present invention relates to a cylindrical shaped microstrip antenna array which operates at a frequency of 231 MHz±400 KHz and which is adapted for use on a weapons system such as a missile or other projectile.

2. Description of the Prior Art

A microstrip antenna operates by resonating at a frequency. The conventional design uses printed circuit techniques to put a printed copper patch on the top of a layer of dielectric with a ground plane on the bottom of the dielectric. The frequency of operation of the conventional microstrip antenna is for the length of the antenna to be approximately a half-wavelength in the microstrip medium of dielectric below the patch and air above the patch.

Another type of microstrip antenna is a quarter-wavelength microstrip antenna which is similar to the half wavelength microstrip antenna except the resonant length is a quarter-wavelength and one side of the antenna is grounded.

There is currently a need to provide an antenna which is similar in design and operates in a manner virtually identical to the quarter-wavelength microwave antenna and also provides for a significant increase in bandwidth.

This microstrip antenna is to be used on a weapons system or projectile such as a missile. There is also a requirement for a frequency of operation for the antenna of 231 MHz±400 KHz.

SUMMARY OF THE INVENTION

The present invention overcomes some of the disadvantages of the past including those mentioned above in that it comprises a highly effective and efficient microstrip antenna designed to transmit telemetry data from a HARM missile at a frequency of 231 MHz±400 KHz. The microstrip antenna comprising the present invention is configured to wrap around a projectile's body without interfering with the aerodynamic design of the projectile.

The microstrip antenna of the present invention has three identical conformal antenna elements equally spaced around the circumference of a projectile's body. The antenna has an operating frequency of 231 MHz±400 KHz, and is designed for use with the HARM missile to transmit Telemetry data.

Each of the three identical antenna elements includes a dielectric printed circuit board, a rectangular shaped radiating element mounted on a top portion of the printed circuit board, and a ground plane mounted on the bottom portion of the printed circuit board.

A plurality of copper wire electrical shorts, i.e. copper vias are provided along one edge of the radiating element to connect the radiating element to the ground plane. The copper electrical shorts are equally spaced apart and run from the midpoint of radiating element to the one corner of the radiating element. The unique placement and configuration of the vias allows for a substantial increase in the width of the radiating element and an increase in the bandwidth to ±400 KHz about the center frequency of 231 KHz.

To achieve the proper polarization, each of the three antenna elements are driven with an equal amplitude signal and a progressive 120 degree phase shift. A three way power divider is used to obtain the equal amplitude signals and the progressive 120 degree phase shift is obtained by proper length of the feed lines from the power divider to each of the three antenna elements.

Each antenna element includes a tuning screw which is used to fine tune the operating frequency of each of the antenna elements of the microstrip antenna.

DETAILED DESCRIPTION OF THE PREFERRED EMBODIMENT

Figure 1:
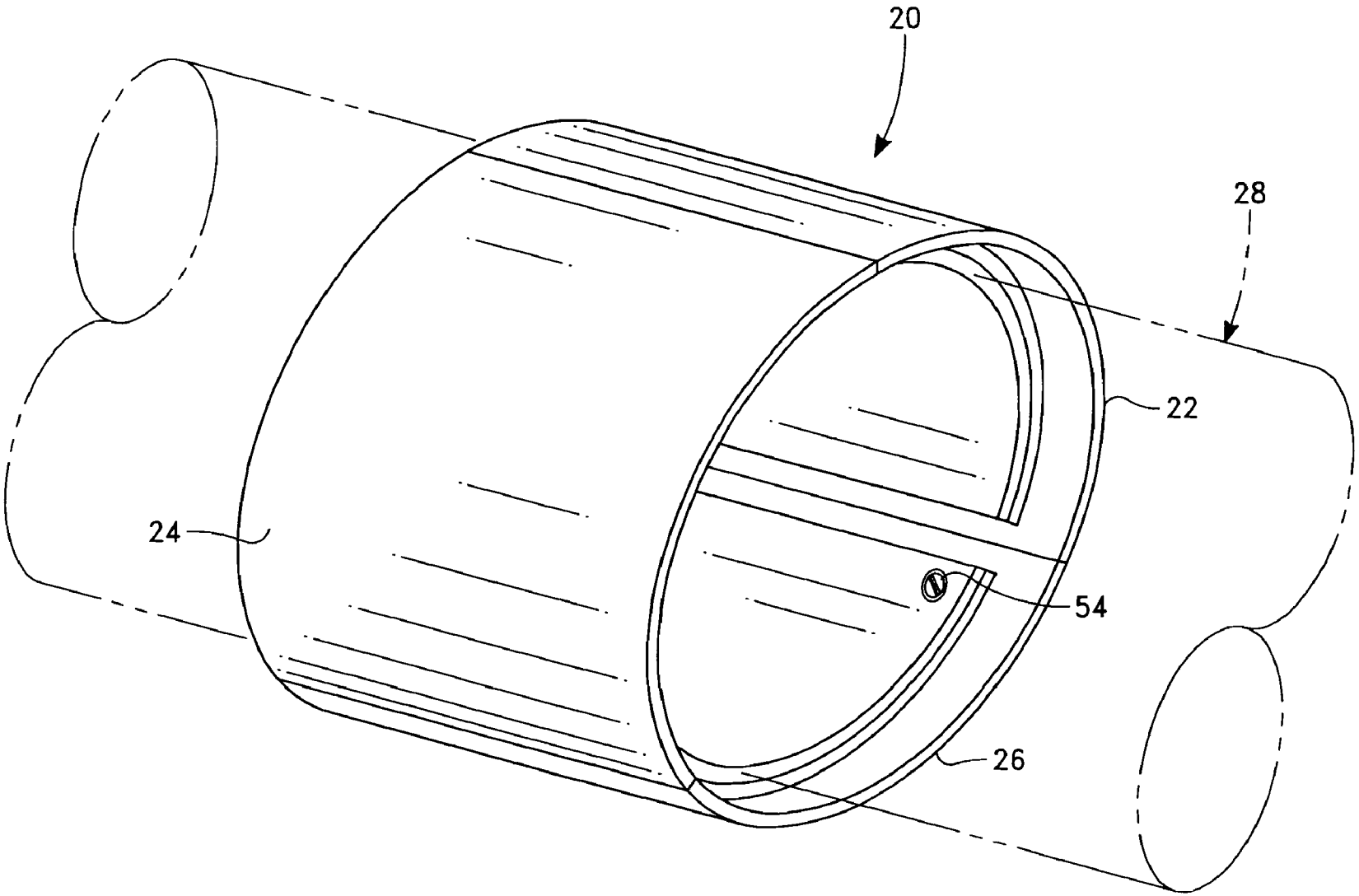
FIG. 1 is a perspective view of the partially shorted microstrip antenna comprising the present invention which includes the three identical antenna elements of the microstrip antenna.
Figure 2:
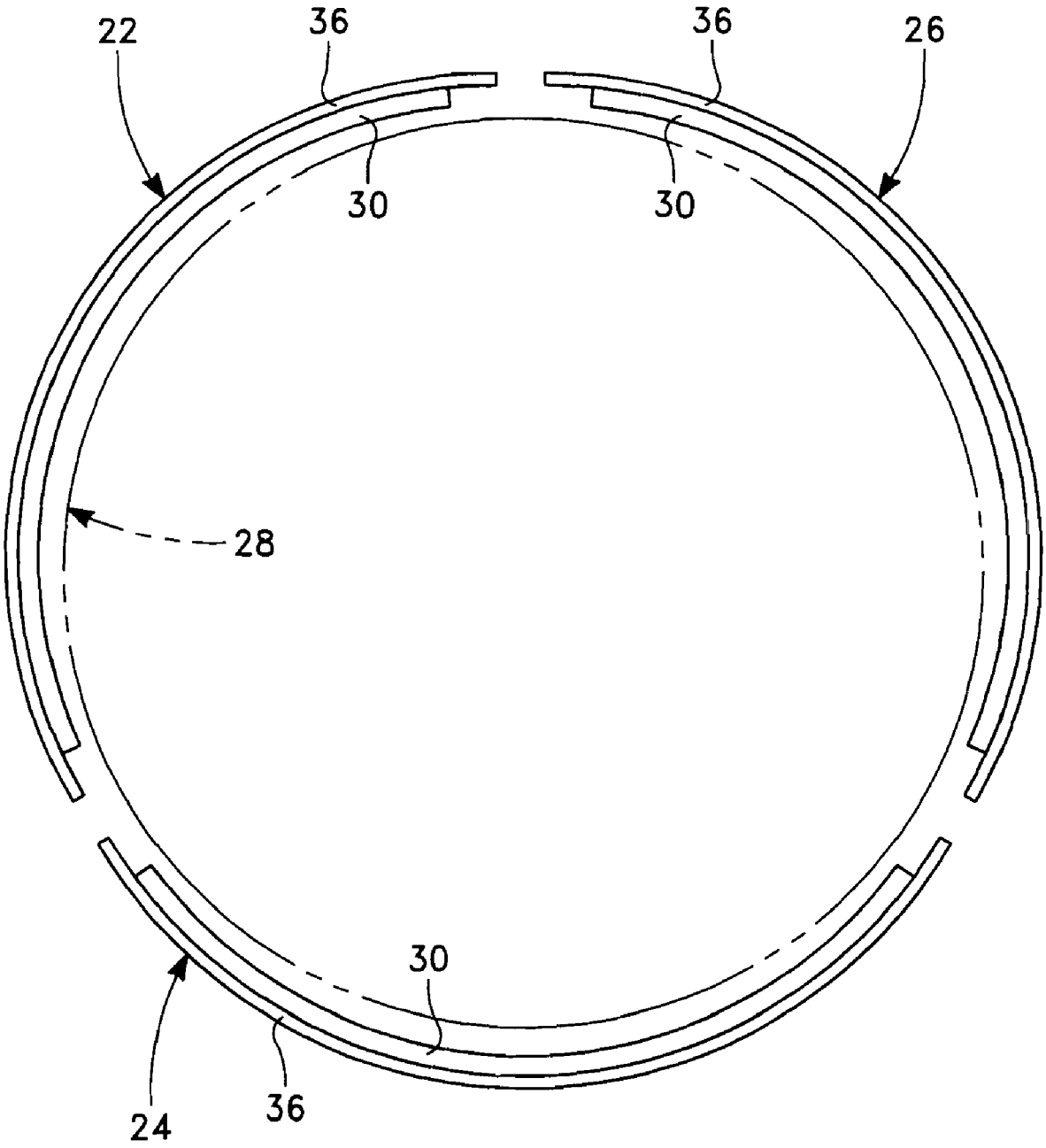
FIG. 2 is an end view of the microstrip antenna of FIG. 1.

Referring to FIG. 1, there is shown a perspective view of a microstrip antenna array 20 which includes three identical conformal antenna elements 22, 24 and 26 which are mounted on the outer surface of a missile 28, shown in phantom in FIG. 1. Each of the three antenna elements 22, 24 and 26 are positioned every 120 degrees around the outer surface of missile 28 in the manner illustrated in FIG. 1. FIG. 2 is an end view of the microstrip antenna 20 of FIG. 1 illustrating the three identical antenna elements 22, 24 and 26 of FIG. 1.

The present invention which comprises antenna array 20 includes the three antenna elements 22, 24, and 26, shown in FIGS. 1 and 2 is designed for use with the HARM missile. The HARM missile is a supersonic air-to-surface missile designed seek and destroy enemy radar-equipped air defense systems. The Navy and Marine Corps F/A-18 and EA-6B have the capability to employ the AGM-88 HARM (high-speed anti-radiation missile). The Harm missile operates in the P band.

Referring to FIGS. 1, 2, 3, and 4A, each of the antenna elements 22, 24 and 26 includes a dielectric printed circuit board 30 fabricated from a plurality of high frequency laminates 32 and 34 (shown in FIG. 4A), part number RT/duroid 6002, commercially available from Rogers Corporation of Rogers, Connecticut. The dielectric laminates/layers 32 and 34 selected for each element antenna 20 has overall dimensions of 9.171 inches by 7.312 inches. The thickness of circuit board 30 is about 0.210 inches. RT/duroid 6002 is a microwave material with low loss and a low dielectric constant providing for excellent electrical and mechanical properties at microwave frequencies. It should be understood that the circuit board 30 can be fabricated from three or more layers of a dielectric laminate material such as RT/duroid 6002.

Each microstrip antenna element 22, 24 and 26 of antenna 20 also has an outer cover 36 which is an environment protection laminate fabricated from Rogers Corporation Duroid 5870 high frequency laminate. The thickness of the outer cover 36 is about 0.125 inches.

Each of the microstrip antenna elements 22, 24 and 26 of antenna 20 includes a generally rectangular shaped copper radiating element or patch 40 which has overall dimension of 8.176 inches in length and a width of 5.304 inches. The copper radiating patch 40 for each microstrip antenna element 22, 24 and 26 of antenna 20 is mounted on the upper surface of the circuit board 30 for each antenna element 22, 24 and 26. Copper plating is used to fabricate the copper radiating patch 40.

Each of the microstrip antenna elements 22, 24 and 26 of antenna 20 also includes a generally rectangular shaped copper ground plane 42. The copper ground plane 42 for each element 22, 24 and 26 is mounted on the bottom surface of the circuit board 30 for each antenna element 22, 24 and 26.

Figure 3:
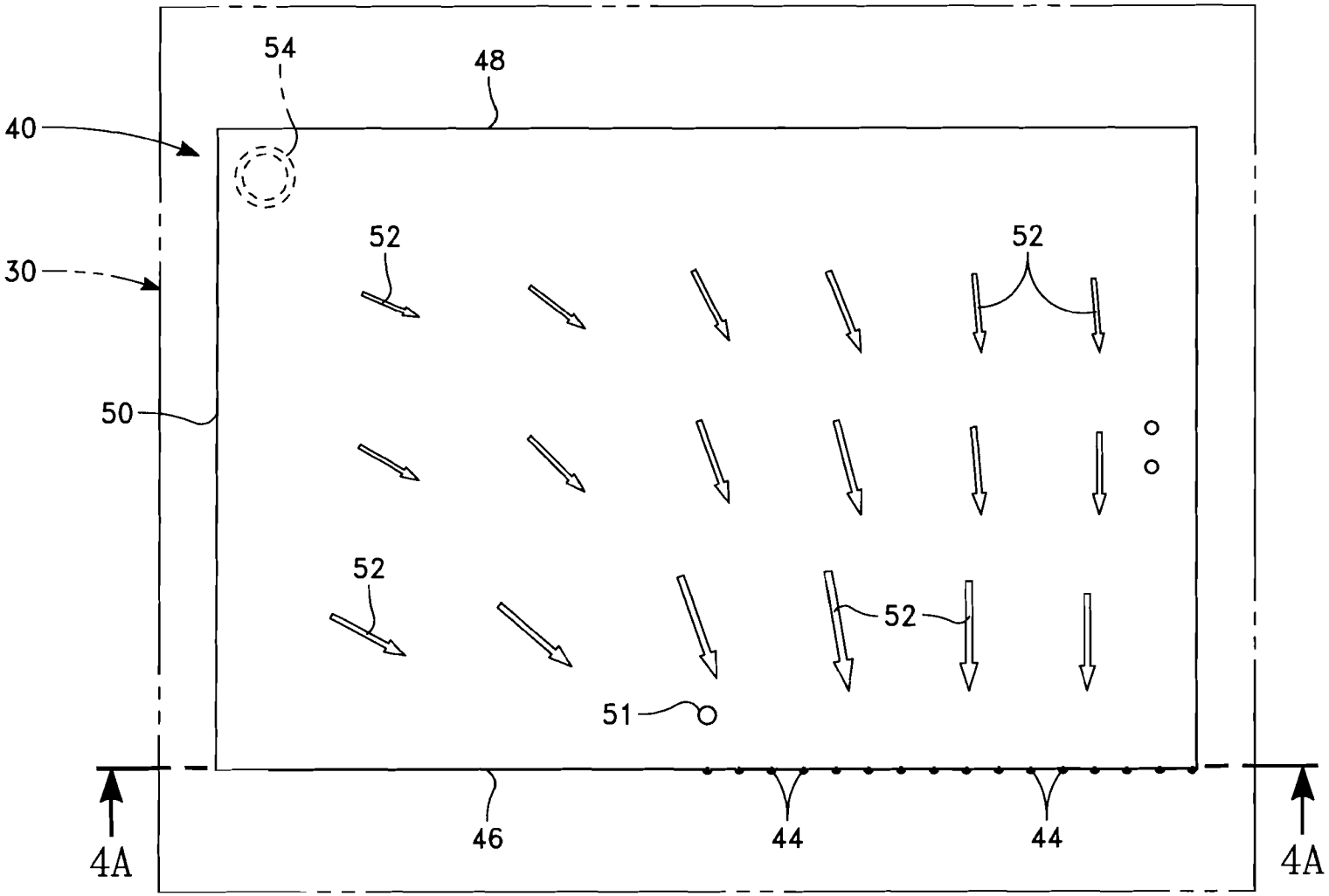
FIG. 3 is a top view of one of three identical microstrip antenna elements including the radiating patch for one of the three identical microstrip antenna elements for the microstrip antenna of FIG. 1.

A plurality of copper wire electrical shorts 44 shown in FIG. 3, i.e. copper vias are provided lengthwise along one edge 46 of radiating element 40 to connect the radiating element 40 to the ground plane 42 of each antenna element 22, 24 and 26. The copper wire electrical shorts/vias 44 are equally spaced apart and run from the midpoint of radiating element 40 to the one corner of the radiating element 40.

As seen in FIG. 3, the radiating element 40 has sixteen vias 44, with each via 44 being spaced apart wire center to center by 0.271 inches from an adjacent via. The placement of vias 44 along lower edge 46 of the radiating element 40 is from the midpoint of radiating element 40 to lower right corner of radiating element 40.

As shown in FIG. 3, current flow in the radiating element is from the upper or opposite edge 48 and left side edge 50 of radiating element 40 to through the vias 44 to the ground plane 42. A plurality of arrows 52 indicating the direction and pattern of current flow on the radiating element 40. The electrical feed 51 for the radiating patch 40 each antenna element 22, 24 and 26 is located near the lower edge 46 of radiating patch 40 at the center of the radiating patch 40.

Antenna 20 receives three equal amplitude RF electrical signals which are provided to the feeds 50 for the microstrip antenna elements 22, 24 and 26. The RF electrical signals are obtained from a commercially available three way power divider(not illustrated). The power divider is electrically connected to each of the three antenna elements 22, 24 and 26 by electrical transmission lines. The electrical transmission lines, which are electrical cables having different lengths, are configured to provide for a 120 degree progressive phase shift. Thus, when the signal to antenna element 22 is 0 degrees, the signal to antenna element 24 will be 120 degrees and the signal to antenna element be 240 degrees.

Figure 6:
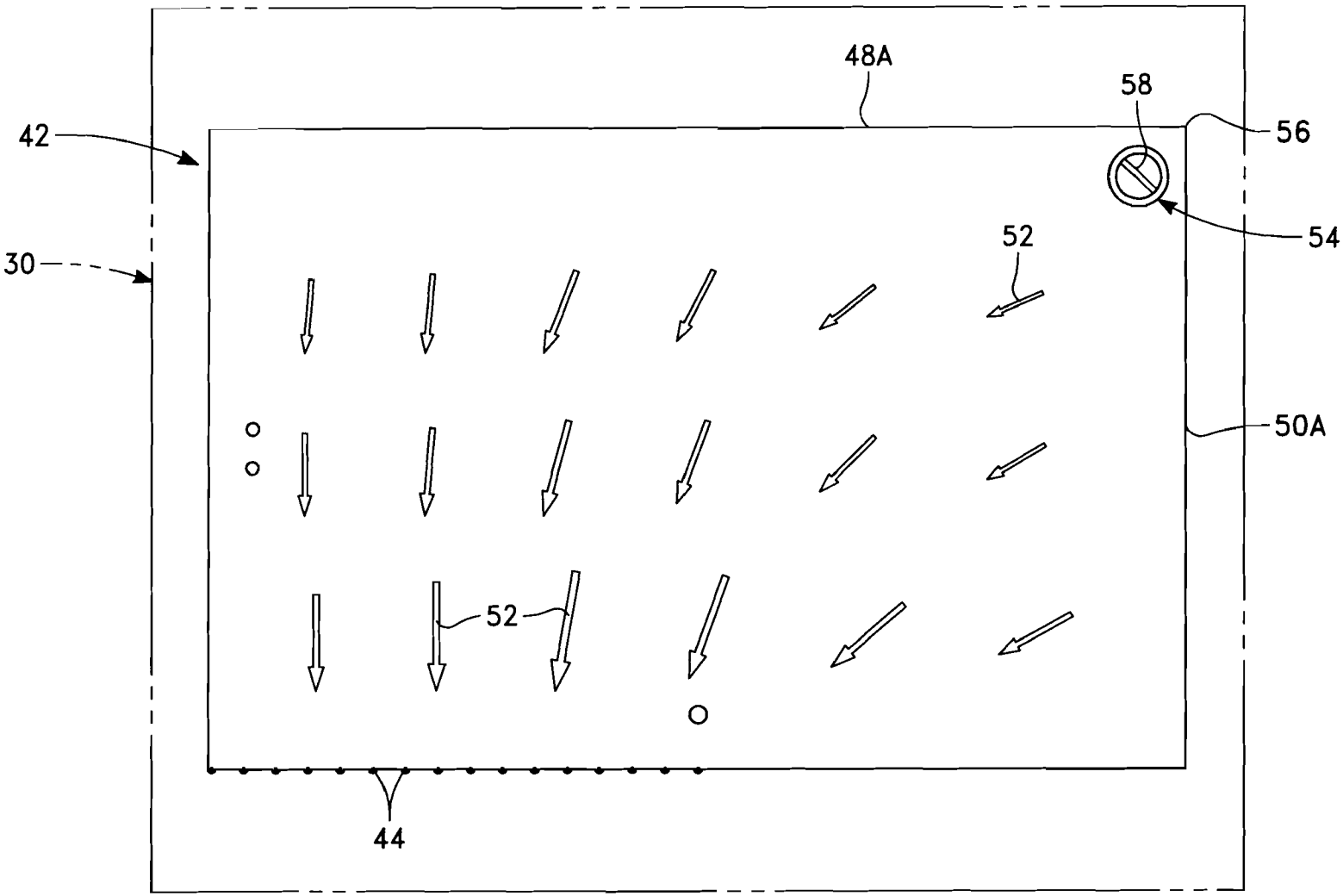
FIG. 6 is a bottom view of one of three identical microstrip antenna elements including the ground plane and tuning screw for one of the three identical microstrip antenna elements for the microstrip antenna of FIG. 1.

Referring to FIGS. 1 and 6, there is shown a tuning screw 54 which is used to fine tune the operating frequency of each antenna elements 22, 24 and 26 of microstrip antenna 20. The tuning screw 54 for each antenna element 22, 24 and 26 is located within the ground plane 42 in proximity to the corner 56 of ground plane 42 where edges 48A and 50A of ground plane 42 meet. A slot 58 is provided within the tuning screw 54. The slot 58 within each antenna element 22, 24 and 26 allows a user to use a screw driver to fine tune the antenna element 22, 24 and 26 to the desired operating frequency. The use of tuning screw eliminates the tuning tabs within each antenna element 22, 24 and 26 which have also been used to fine tune antenna elements to a desired operating frequency.

Figure 7:
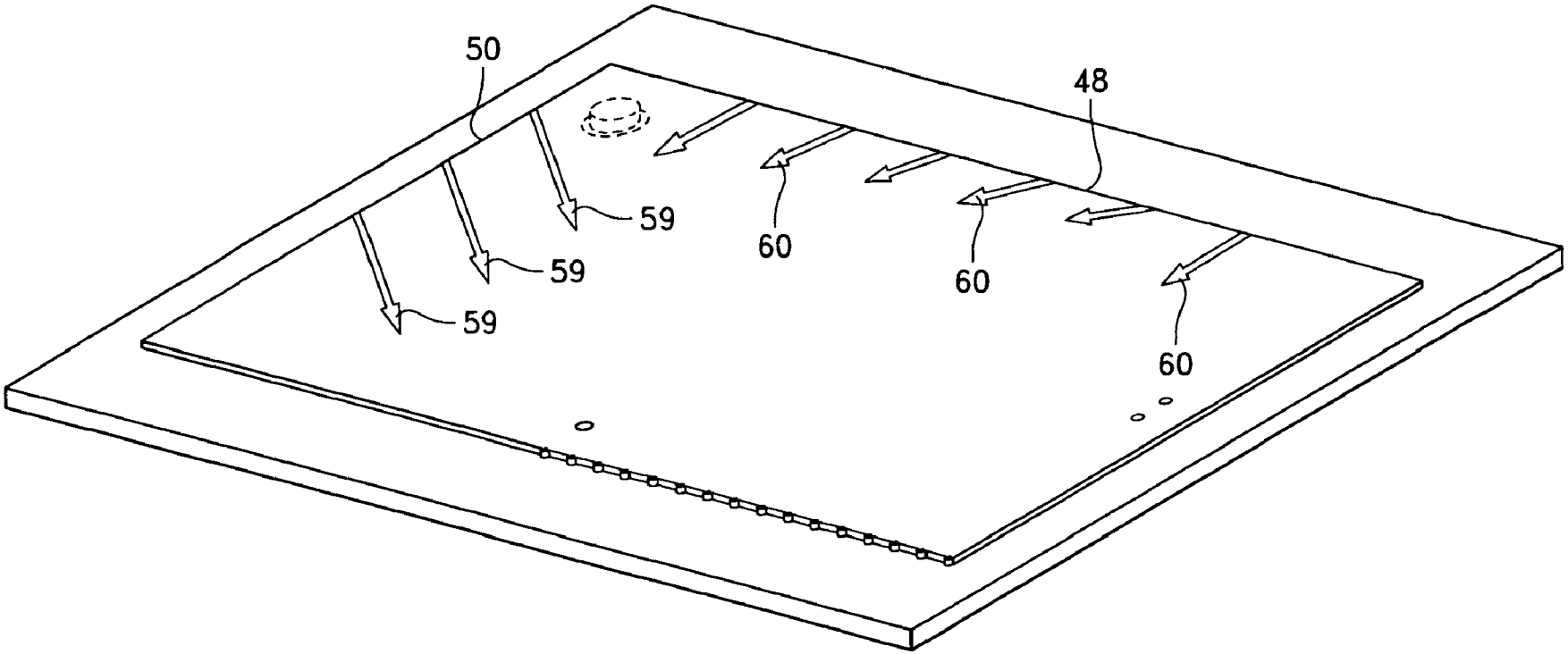
FIG. 7 is a view illustrating the electric fields generated by the radiating element for each of the antennas elements of the microstrip antenna of FIG. 1.

Referring to FIG. 7, there is shown a general directional pattern for the electric field generated by each of the antenna elements 22, 24 and 26 of antenna 20. This electric field is represented by electric field vectors 59 generated along edge 50 and electric field vectors 60 generated along edge 62.

Figure 4A:
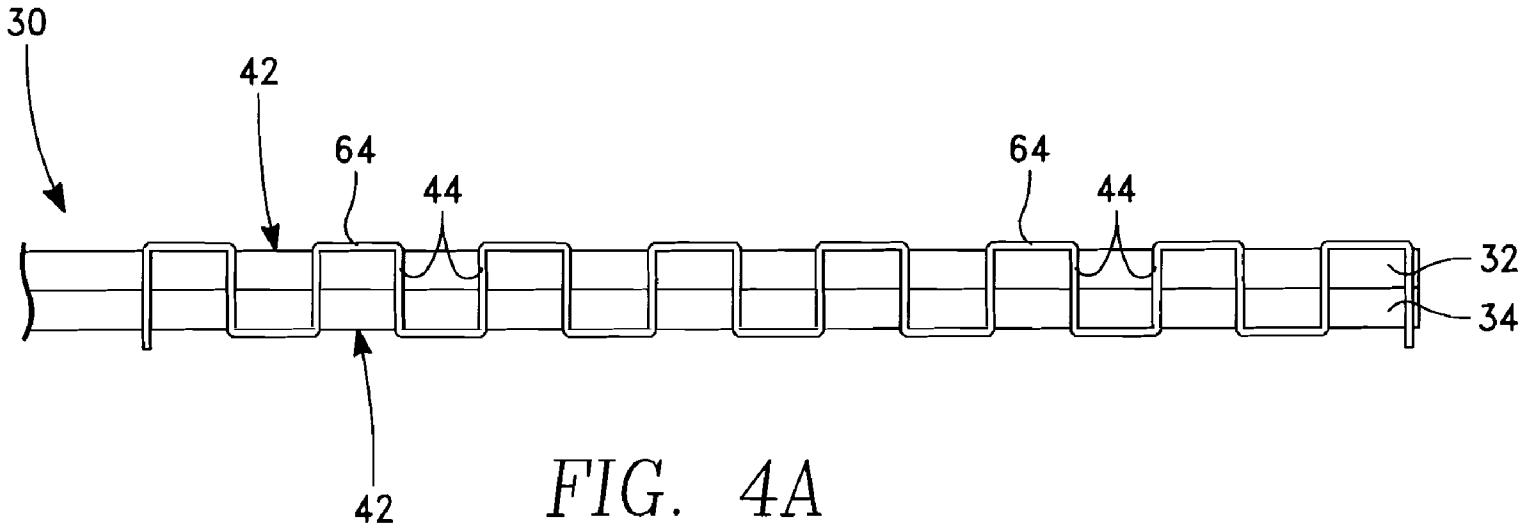
FIGS. 4A and 4B are side view illustrating the copper wire electrical shorts, i.e. copper vias which are provided along one edge of the radiating element to connect the radiating element to the ground plane of each the antenna elements of the microstrip antenna of FIG. 1.
Figure 4B:
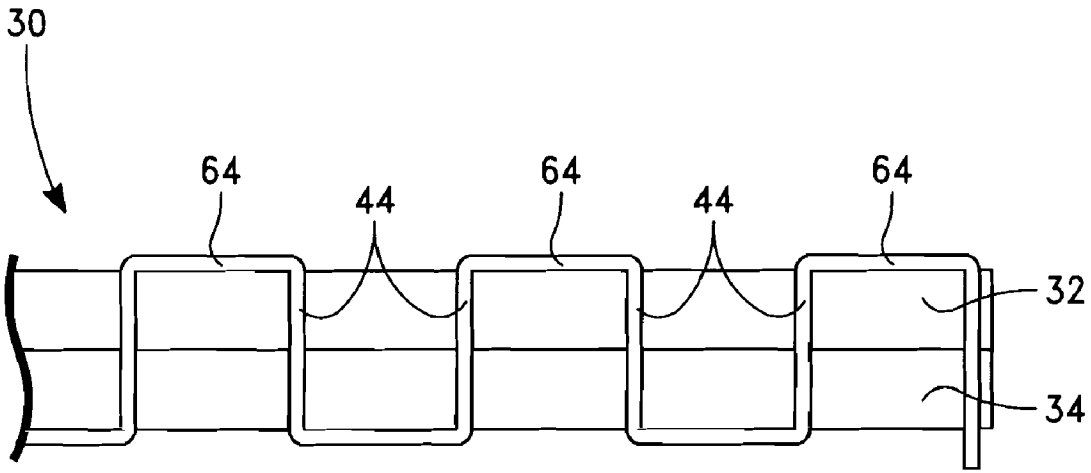

Referring to FIGS. 3, 4A and 4B, there is shown a plurality of copper wire electrical shorts 44, i.e. copper vias 44 which are provided along one edge of the radiating element and through the dielectric printed circuit board 30 (as shown in FIGS. 4A and 4B) to connect the radiating element 40 to the ground plane 42 (shown in FIG. 6). The copper electrical shorts 44 are equally spaced apart and run from the midpoint of radiating element 40 to the one corner of the radiating element 40. The unique placement and configuration of the vias 44 allows for a substantial increase in the width of the radiating element 40 and an increase in the bandwidth to ±400 KHz about the center frequency of 231 KHz.

Figure 5:
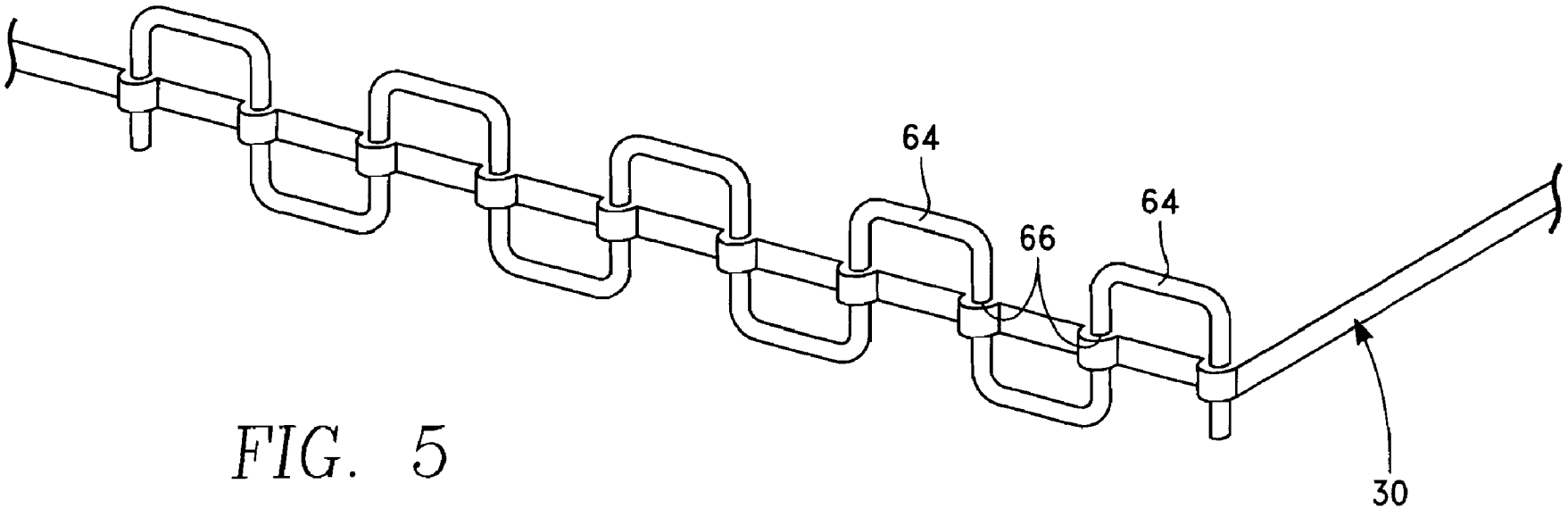
FIG. 5 is a side view illustrating the stringing technique to fabricate the copper electrical shorts/vias of FIG. 4.

As shown in FIG. 5, a single wire copper wire 64 is strung through a plurality of openings 66 in the dielectric printed circuit board 30 is used to fabricate the copper electrical shorts/vias 44 for connecting the radiating element 40 to the ground plane 42 of each of the antenna elements 22, 24 and 26. The copper wire 64 is then pulled through the openings 66 until the copper wire 64 is flush and in contact with radiating element 40 and the ground plane 42 (as shown in FIG. 4A). Solder can then be used to secure the radiating element 40 and copper wire 64 to the ground plane 42.

It should be noted that there are openings drilled into the radiating element 40 and the ground plane 42 which align with the openings 66 drilled into the dielectric printed circuit board 30.

Utilizing the stringing technique illustrated in FIGS. 4A, 4B and 5, saves a considerable amount time and money in fabricating the vias 44 for each of the antenna elements 22, 24 and 26 of antenna 20. Using the prior technique of fabricating each separately by placing a separate copper wire in each opening 66 in the dielectric printed circuit board 30 and then soldering the wire to the ground plane and the radiating element required several hours of intensive labor and substantially raised the fabrication cost of the antenna.

Figure 8A:
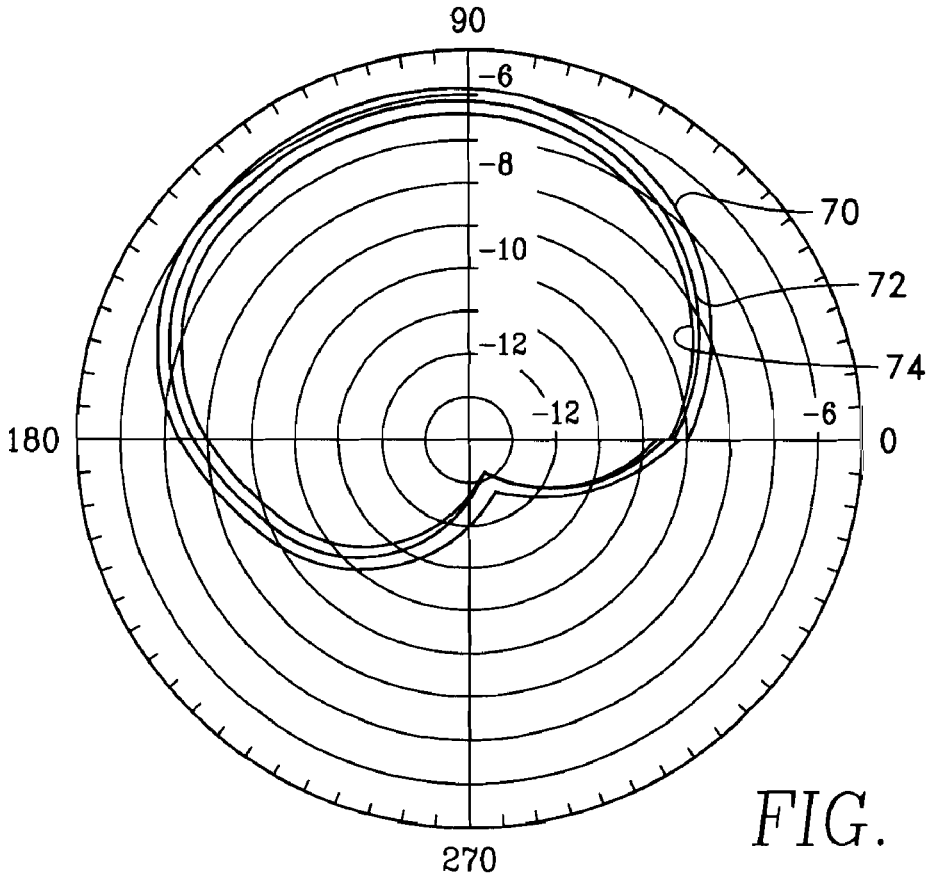
FIGS. 8A and 8B are antenna performance plots for the one of the antennas elements of the microstrip antenna of FIG. 1.
Figure 8B:
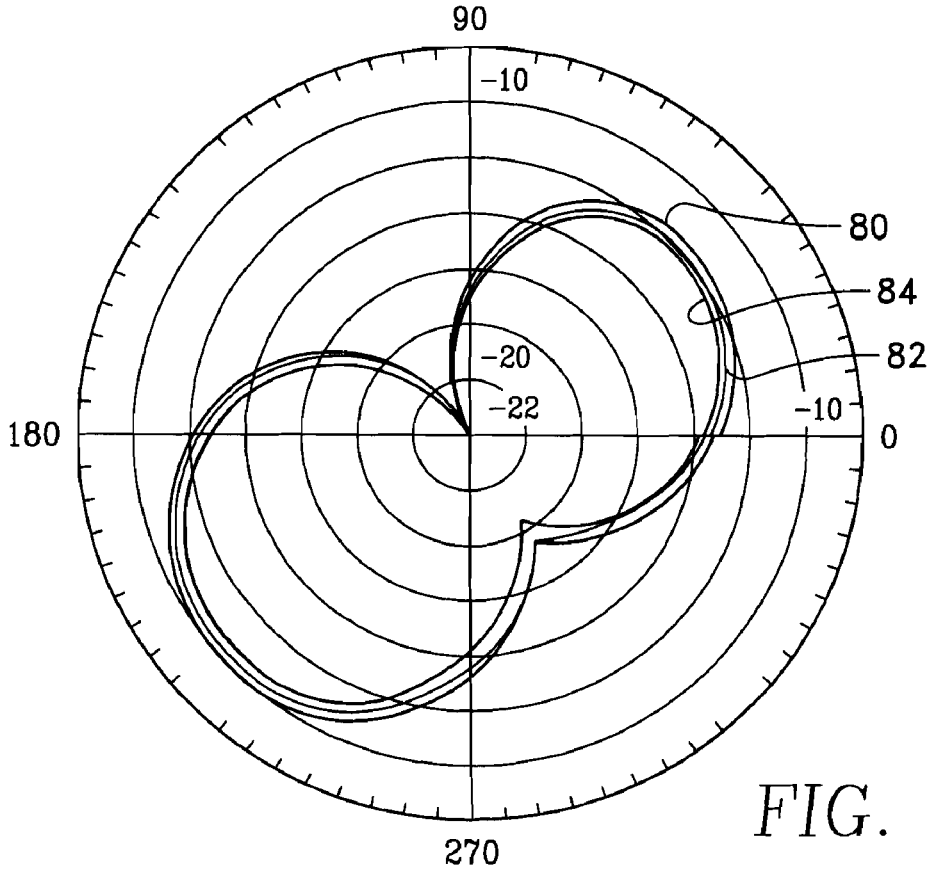

Referring to FIGS. 8A and 8B, there is shown antenna performance plots for one of the antenna elements of the microstrip antenna 20 of FIG. 1. The antenna performance plots 70, 72 and 74 of FIG. 8A illustrate horizontal polarization for one antenna element 22, 24 or 26 of the microstrip antenna 20 of FIG. 1. The antenna element was mounted on a ten inch diameter tube which simulated a missile, and measurements were made looking perpendicular into the missile. The antenna performance plots 80, 82 and 84 of FIG. 8A illustrate horizontal polarization for one antenna element 22, 24 or 26 of the microstrip antenna 20 of FIG. 1. The plots of FIGS. 8A and 8B show that the microstrip antenna has excellent cross polarization performance.

From the foregoing, it is readily apparent that the present invention comprises a new, unique, and exceedingly useful microstrip antenna adapted for use on projectiles such as the harm missile, which constitutes a considerable improvement over the known prior art. Many modifications and variations of the present invention are possible in light of the above teachings. It is to be understood that within the scope of the appended claims the invention may be practiced otherwise than as specifically described.

What is claimed is:

1. A microstrip antenna adapted for use on a missile comprising:

(a) first, second and third rectangular shaped 120-degree microstrip antenna elements mounted on an outer surface of said missile adjacent to one another, each of said first, second and third 120-degree microstrip antenna elements including:

(i) a first dielectric layer operating as a protective layer for each of said 120-degree microstrip antenna elements;

(ii) a second dielectric layer positioned below said first dielectric layer within each of said 120-degree microstrip antenna elements, said second dielectric layer having an upper surface and a lower surface;

(iii) a rectangular shaped copper radiating element mounted on the upper surface of said second dielectric layer;

(iv) a rectangular shaped ground plane mounted on the lower surface of said second dielectric layer;

(v) a plurality of equally spaced apart aligned copper vias passing through a plurality of openings located in said second dielectric layer, wherein said plurality of vias are located near one edge of said radiating element from a midpoint of said radiating element extending to a corner of said radiating element;

(vi) said plurality of vias connecting said radiating element to the ground plane of each of said first, second and third rectangular shaped 120-degree microstrip antenna elements to form a partial short circuit from said radiating element to said ground plane; and (vii) a tuning screw positioned within said second dielectric substrate and said ground plane at a corner of said ground plane which is diagonally opposite the corner of said radiating element which includes one of said plurality of vias;

(b) said first, second and third 120-degree microstrip antenna elements generating a radiation pattern which includes horizontal polarization and vertical polarization with cross polarization at an operating frequency for said microstrip antenna of 231 MHz; and (c) said partial short circuit providing for a current flow pattern through said radiating element and said plurality vias to said ground plane for each of said first, second and third 120-degree microstrip antenna elements which allows for a substantial increase in the bandwidth of said microstrip antenna to ±400 KHz about the operating frequency for said microstrip antenna of 231 MHz.

2. The microstrip antenna of claim 1 wherein the radiating element for each of said first, second and third 120-degree microstrip antenna elements has overall dimensions of 8.176 inches in length and a width of 5.304 inches.

3. The microstrip antenna of claim 1 wherein the second dielectric layer for each of said first, second and third 120-degree microstrip antenna elements has overall dimensions of 9.171 inches in length and a width of 7.312 inches.

4. The microstrip antenna of claim 3 wherein the thickness of said second dielectric layer is about 0.210 inches.

5. The microstrip antenna of claim 1 wherein said plurality of vias consist of sixteen copper vias equally spaced apart from one another by approximately 0.271 inches.

6. The microstrip antenna of claim 1 wherein the radiating element for each of said first, second and third 120-degree microstrip antenna elements includes an electrical signal feed for providing an equal amplitude RF signal to the electrical signal feed with a 120 degree progressive phase shaft of said equal amplitude RF signals, said equal amplitude signals to each of said first, second and third 120-degree microstrip antenna elements being progressively phase shifted by said 120 degree progressive phase shaft to obtain the horizontal polarization and the vertical polarization of the electromagnetic filed generated by said microstrip antenna.

7. The microstrip antenna of claim 1 wherein said cross polarization at the operating frequency for said microstrip antenna of 231 MHz occur because of the horizontal polarization and the vertical polarization of the electromagnetic filed generated by said microstrip antenna.

8. The microstrip antenna of claim 1 wherein said tuning screw for each of said first, second and third 120-degree microstrip antenna elements allows a user to fine tune the operating frequency of said microstrip antenna within the bandwidth of ±400 KHz about the operating frequency of 231 MHz of said microstrip antenna.

9. The microstrip antenna of claim 1 wherein said ground plane is fabricated from copper plate.

10. A microstrip antenna adapted for use on a missile comprising:

(a) first, second and third rectangular shaped 120-degree microstrip antenna elements mounted on an outer surface of said missile adjacent to one another, each of said first, second and third 120-degree microstrip antenna elements including:

(i) a first dielectric layer operating as a protective layer for each of said 120-degree microstrip antenna elements;

(ii) a second dielectric layer positioned below said first dielectric layer within each of said 120-degree microstrip antenna elements, said second dielectric layer having an upper surface and a lower surface;

(iii) a rectangular shaped copper radiating element mounted on the upper surface of said second dielectric layer;

(iv) a rectangular shaped ground plane mounted on the lower surface of said second dielectric layer, wherein said ground plane is fabricated from copper plate;

(v) sixteen equally spaced apart aligned copper vias passing through sixteen openings located in said second dielectric layer, wherein said sixteen copper vias are located near one edge of said radiating element from a midpoint of said radiating element extending to a corner of said radiating element;

(vi) said sixteen copper vias connecting said radiating element to the ground plane of each of said first, second and third rectangular shaped 120-degree microstrip antenna elements to form a partial short circuit from said radiating element to said ground plane; and (vii) a tuning screw positioned within said second dielectric layer and said ground plane at a corner of said ground plane which is diagonally opposite the corner of said radiating element which includes one of said sixteen copper vias;

(b) said first, second and third 120-degree microstrip antenna elements generating a radiation pattern which includes horizontal polarization and vertical polarization with cross polarization at an operating frequency for said microstrip antenna of 231 MHz; and (c) said partial short circuit providing for a current flow pattern through said radiating element and said sixteen copper vias to said ground plane for each of said first, second and third 120-degree microstrip antenna elements which allows for a substantial increase in the bandwidth of said microstrip antenna to ±400 KHz about the operating frequency for said microstrip antenna of 231 MHz;

(d) said tuning screw for each of said first, second and third 120-degree microstrip antenna elements allowing a user to fine tune the operating frequency of said microstrip antenna within the bandwidth of ±400 KHz about the operating frequency of 231 MHz of said microstrip antenna.

11. The microstrip antenna of claim 10 wherein the radiating element for each of said first, second and third 120-degree microstrip antenna elements has overall dimensions of 8.176 inches in length and a width of 5.304 inches.

12. The microstrip antenna of claim 10 wherein the second dielectric layer for each of said first, second and third 120-degree microstrip antenna elements has overall dimensions of 9.171 inches in length and a width of 7.312 inches.

13. The microstrip antenna of claim 12 wherein the thickness of said second dielectric layer is about 0.210 inches.

14. The microstrip antenna of claim 10 wherein said sixteen copper vias are equally spaced apart from one another by approximately 0.271 inches.

15. The microstrip antenna of claim 10 wherein the radiating element for each of said first, second and third 120-degree microstrip antenna elements includes an electrical signal feed for providing an equal amplitude RF signal to the electrical signal feed with a 120 degree progressive phase shaft of said equal amplitude RF signals, said equal amplitude signals to each of said first, second and third 120-degree microstrip antenna elements being progressively phase shifted by said 120 degree progressive phase shaft to obtain the horizontal polarization and the vertical polarization of the electromagnetic filed generated by said microstrip antenna.

* * * * *